US011452946B2

(12) United States Patent
Patel et al.

(10) Patent No.: US 11,452,946 B2
(45) Date of Patent: Sep. 27, 2022

(54) HUMAN-POWERED MECHANICAL TOY BATTERS

(71) Applicants: Bhupendra M Patel, Fremont, CA (US); Jagdish M Patel, Fremont, CA (US)

(72) Inventors: Bhupendra M Patel, Fremont, CA (US); Jagdish M Patel, Fremont, CA (US)

( * ) Notice: Subject to any disclaimer, the term of this patent is extended or adjusted under 35 U.S.C. 154(b) by 0 days.

(21) Appl. No.: 17/211,821

(22) Filed: Mar. 25, 2021

(65) Prior Publication Data

US 2021/0252417 A1 Aug. 19, 2021

Related U.S. Application Data

(63) Continuation-in-part of application No. 17/103,929, filed on Nov. 24, 2020, now abandoned.

(60) Provisional application No. 62/939,671, filed on Nov. 24, 2019.

(51) Int. Cl.

| | |
|---|---|
| ***A63H 13/04*** | (2006.01) |
| ***A63F 7/06*** | (2006.01) |
| ***A63H 29/24*** | (2006.01) |

(52) U.S. Cl.

CPC ..... *A63H 13/04* (2013.01); *A63H 29/24* (2013.01)

(58) Field of Classification Search

CPC ..... A63H 3/20; A63H 13/04; A63H 29/24; A63F 7/0608; A63F 7/2472

USPC ..... 446/107, 330, 336; 273/108.1, 108.3, 273/108.32, 129 R, 129 V, 129 W, 317.9

See application file for complete search history.

(56) References Cited

U.S. PATENT DOCUMENTS 1,168,829 A * 1/1916 Sheppard ..... A63F 7/0608 446/308
1,469,605 A * 10/1923 Piercy ..... A63H 13/04 273/317.8
1,481,105 A * 1/1924 Levy ..... A63F 7/0608 273/129 R
1,481,247 A * 1/1924 Wickes ..... A63F 7/0608 273/317.7
1,588,440 A * 6/1926 Boosey ..... A63F 7/249 273/317.9
1,644,047 A * 10/1927 Wetzell ..... A63H 13/10 124/79
1,658,054 A * 2/1928 Levy ..... A63F 7/249 273/317.9

(Continued)

FOREIGN PATENT DOCUMENTS

DE 102015212909 B3 * 10/2016
GB 2272841 A * 6/1994 ..... A63F 7/0676

(Continued)

*Primary Examiner* — Alexander R Niconovich

(57) ABSTRACT

A humanoid batter toy system comprising: a baseball home plate comprising: a bottom plate, a top plate, wherein the set of gear transfers the torque force to the leg shaft. The baseball batter humanoid includes the leg shaft coupled to a hip gear in the baseball batter humanoid, wherein the hip gear receives the torque force uses the torque force to cause an upper torso of baseball batter humanoid to rotate a baseball bat in a batter swinging motion, wherein the metal rope is placed in a central manner within the upper torso portion and when metal wire rope is pulled, the shoulder rotation of the baseball batter humanoid occurs.

19 Claims, 9 Drawing Sheets

(56) References Cited

U.S. PATENT DOCUMENTS 1,685,428 A * 9/1928 Lowry ..... A63F 7/0608 273/317.7
1,728,799 A * 9/1929 Levin ..... A63H 13/04 273/317.9
2,289,421 A * 7/1942 Grieshaber ..... A63F 9/0252 473/107
2,296,541 A * 9/1942 Schuyler ..... A63H 13/04 446/308
2,506,190 A * 5/1950 Barnes ..... A63F 7/2472 124/79
2,596,557 A * 5/1952 Huber ..... A63F 7/2472 273/129 R
2,722,211 A * 11/1955 Eisele ..... A63F 7/2472 273/317.8
2,960,796 A * 11/1960 Woodrey ..... A63H 13/04 74/25
3,190,653 A * 6/1965 Karthaus ..... A63F 7/2472 273/129 R
3,525,320 A * 8/1970 Leonid ..... A63F 7/249 124/16
3,834,703 A * 9/1974 Dlouhy ..... A63F 7/0608 124/4
3,862,513 A * 1/1975 Isaacson ..... A63H 13/12 446/268
3,874,112 A * 4/1975 Sapkus ..... A63H 13/12 446/268
4,078,800 A * 3/1978 Goldfarb ..... A63F 7/0608 124/16
4,085,540 A * 4/1978 Jernstrom ..... A63H 13/04 125/5
4,186,518 A * 2/1980 Luke ..... A63F 7/2472 446/268
4,262,905 A * 4/1981 Lyons ..... A63F 7/2472 273/317.9
5,020,801 A * 6/1991 Negron ..... A63F 7/0608 273/129 V
5,069,460 A * 12/1991 Kulesza ..... A63F 7/06 273/355
5,201,520 A * 4/1993 Castle ..... A63F 7/0608 273/317.9
5,299,967 A * 4/1994 Gilbert ..... A63H 13/04 273/317.1
5,409,221 A * 4/1995 Cohn ..... A63F 7/0608 273/108.31
6,022,263 A * 2/2000 Liu ..... A63H 3/20 446/379
6,171,169 B1 * 1/2001 Saunders ..... A63H 13/04 446/139
6,280,285 B1 * 8/2001 Morehouse ..... A63F 7/2472 124/79
6,439,952 B1 * 8/2002 Yamamura ..... A63H 3/46 446/376
6,682,071 B1 * 1/2004 Carsten ..... A63F 7/249 273/108.53
7,207,564 B2 * 4/2007 Bedford ..... A63F 9/02 273/386
7,338,342 B2 * 3/2008 Bellon ..... A63H 13/04 446/361
9,022,832 B1 * 5/2015 Skripps ..... A63H 3/46 446/376
9,901,797 B2 * 2/2018 Piggott ..... A63B 59/50
2012/0309262 A1 * 12/2012 Uehara ..... A63H 3/18 446/391
2014/0035226 A1 * 2/2014 Dayal ..... A63F 7/0608 273/129 V
2014/0295729 A1 * 10/2014 Blalock ..... A63H 13/04 446/355
2018/0345126 A1 * 12/2018 Harper ..... A63H 13/04
2021/0252417 A1 * 8/2021 Patel ..... A63H 13/04
2022/0126218 A1 * 4/2022 Chen ..... A63H 33/042

FOREIGN PATENT DOCUMENTS

GB 2343126 A * 5/2000 ..... A63H 13/10
KR 880004192 Y1 * 11/1988

* cited by examiner

HUMAN-POWERED MECHANICAL TOY BATTERS

CROSS-REFERENCE TO RELATED APPLICATIONS

This application claims priority to U.S. patent application Ser. No. 17/103,929, filed on 24 Nov. 2020 and titled METHODS AND SYSTEMS OF HUMAN-POWERED HUMANOID DEVICES.

U.S. patent application Ser. No. 17/103,929 claims priority to U.S. Provisional Patent Application No. 62/939,671 filed on 24 Nov. 2019. These patent applications are hereby incorporated by reference in their entirety.

BACKGROUND

Field of Invention

This invention relates generally mechanical today and more specifically to human-powered mechanical toy batters.

Background

Tabletop games can be used to simulate real sports. Example popular forms for tabletop games currently include, among others, electric football, table football (e.g. football), table hockey games, etc. In these examples, player figures typically are static toys not capable of moving appendages or include very simple forms of moving appendages. However, batting and pitching/bowling simulated sports require use of humanoid player figures capable of more complicated and independent movements. For example, a batting motion uses various independent rotation movements as well as a forward arm motion to have a bat hit an incoming ball. Accordingly, improvements to the mechanical movement systems of batter player figures are desired.

BRIEF SUMMARY OF THE INVENTION

In one aspect, a humanoid batter toy system comprising: a baseball home plate for mounting a baseball batter humanoid, wherein the baseball home plate comprises: a bottom plate, a top plate, wherein the top plate is coupled with the bottom plate, wherein a cavity between the coupled top plate and bottom plate includes a lever coupled with a first gear of a set of gears that are coupled with a leg shaft in a leg of the baseball batter humanoid and wherein the set of gear transfers the torque force to the leg shaft; and the baseball batter humanoid comprising: wherein the leg shaft is coupled to a hip gear in the baseball batter humanoid, wherein the hip gear receives the torque force and uses the torque force to cause an upper torso of baseball batter humanoid to rotate a baseball bat held by the baseball batter humanoid in a batter swinging motion, wherein the upper torso of the baseball batter humanoid comprises a metal wire rope passing through the center of the rotation of an upper torso portion of the baseball batter humanoid, wherein the metal rope is placed in a central manner within the upper torso portion such that when metal wire rope is pulled, the shoulder rotation of the baseball batter humanoid occurs without impacting the torso rotation, and wherein the baseball batter humanoid is mounted to the top plate such that the leg shaft receives the torque force from the set of gears.

Figure 1:
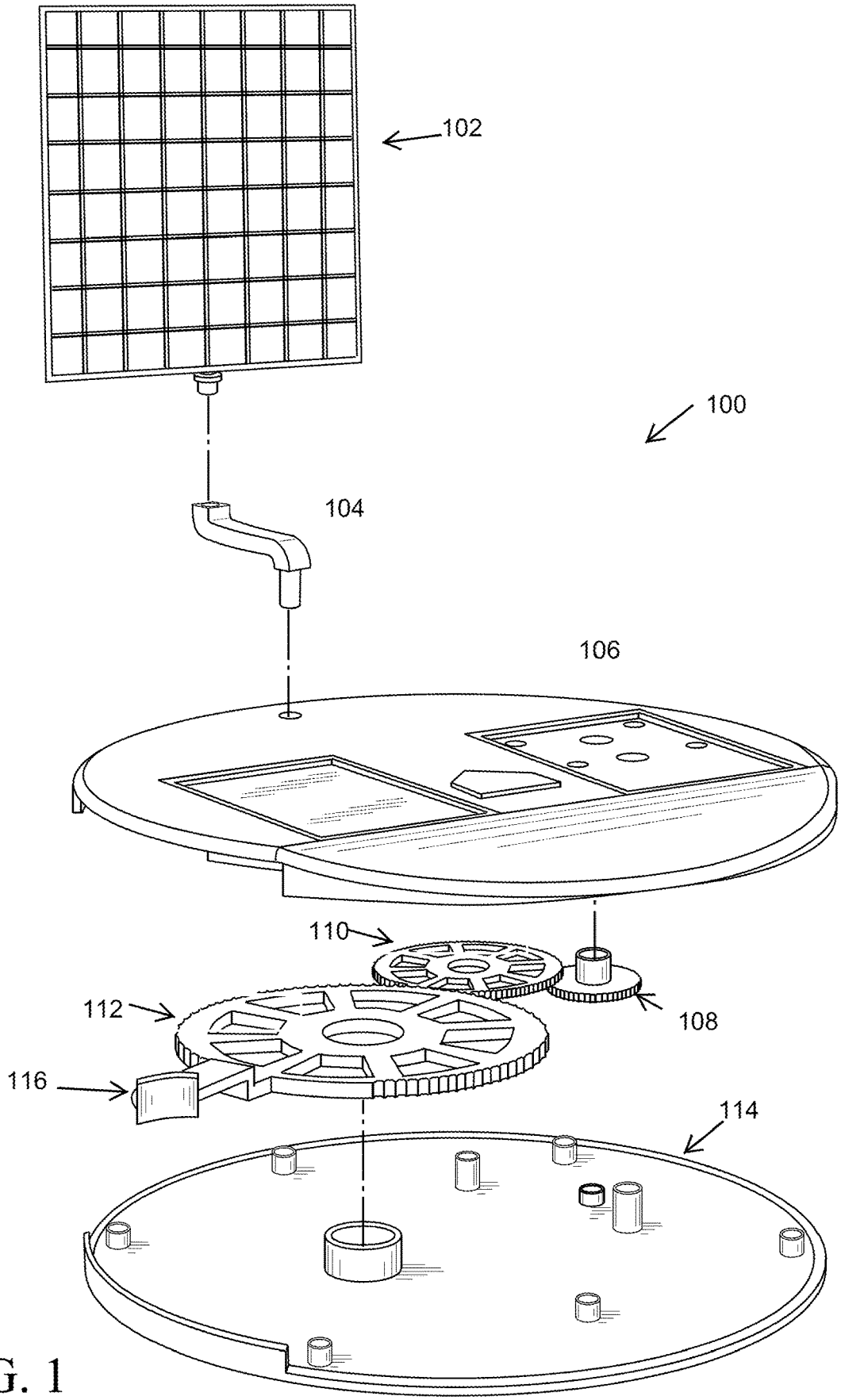
FIG. 1 illustrates an example baseball home plate for mounting a baseball batter humanoid, according to some embodiments.

The Figures described above are a representative set and are not exhaustive with respect to embodying the invention.

DESCRIPTION

Disclosed are a system, method, and article of human-powered mechanical toy batters. The following description is presented to enable a person of ordinary skill in the art to make and use the various embodiments. Descriptions of specific devices, techniques, and applications are provided only as examples. Various modifications to the examples described herein can be readily apparent to those of ordinary skill in the art, and the general principles defined herein may be applied to other examples and applications without departing from the spirit and scope of the various embodiments.

Reference throughout this specification to 'one embodiment,' 'an embodiment,' 'one example,' or similar language means that a particular feature, structure, or characteristic described in connection with the embodiment is included in at least one embodiment of the present invention. Thus, appearances of the phrases 'in one embodiment,' 'in an embodiment,' and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art can recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, and they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

When an element is referred to as being "mounted on," "engaged to," "connected to" or "coupled to" another element, etc., it may be directly on, engaged, connected, or coupled to the other element.

Terms such as "inner," "outer," "beneath," "below," "lower," "above," "upper" and the like, may be used in the present disclosure to describe relationships between different elements as depicted from the figures.

Definitions

Example definitions for some embodiments are now provided.

Acrylonitrile butadiene styrene (ABS) is a common thermoplastic polymer.

Bore can be the diameter of the hole in the center of a gear, bushing, bearing, etc.

Cricket is a bat-and-ball game played between two teams of eleven players on a field. As used herein, cricket can include a simulation version of cricket with human-powered humanoid devices (e.g. as played on a tabletop, etc.).

Gear is a rotating circular machine part having cut teeth or, in the case of a cogwheel or gearwheel, inserted teeth (e.g. cogs), which mesh with another toothed part to transmit torque. Geared devices can change the speed, torque, and direction of a power source. Gears of different sizes produce a change in torque, creating a mechanical advantage, through their gear ratio, and thus may be considered a simple machine. The rotational speeds, and the torques, of two meshing gears differ in proportion to their diameters.

Gear train can be a mechanical system formed by mounting gears on a frame such that the teeth of the gears engage. Gear teeth can be designed to ensure the pitch circles of engaging gears roll on each other without slipping, providing a smooth transmission of rotation from one gear to the next.

Polyoxymethylene (POM) is an engineering thermoplastic used in precision parts requiring high stiffness, low friction, and excellent dimensional stability. It is noted that other synthetic polymers can be utilized as well. POM can be known as, inter alia: Delrin, Kocetal, Ultraform, Celcon, Ramtal, Duracon, Kepital, Polypenco, and Hostaform.

Pulley is a wheel on an axle or shaft that is designed to support movement and change of direction of a taut cable or belt, or transfer of power between the shaft and cable or belt. A pulley can have a groove or grooves between flanges around its circumference to locate the cable or belt.

Rack and pinion is a type of linear actuator that comprises a circular gear (i.e. a pinion) engaging a linear gear (i.e. a rack), which operate to translate rotational motion into linear motion. Driving the pinion into rotation causes the rack to be driven linearly. Driving the rack linearly will cause the pinion to be driven into a rotation. A rack and pinion drive can use both straight and helical gears depending on the embodiment.

Shaft is a rotating machine element (e.g. circular in cross section, etc.) which is used to transmit power from one part to another. Transmission shafts can be used to transmit power between the source and the machine absorbing power (e.g. counter shafts, line shafts, etc.). It is noted that in some examples, shafts and gears herein can be composed of various alloys such as: alloy steel (such as nickel, nickel-chromium or chromium-vanadium steel, etc.).

Wicket can be one of the two sets of three stumps and two balls at either end of the pitch. The fielding team's players can hit the wicket with the ball in a number of ways to obtain a batsman out.

Example Systems and Methods

Disclosed are a set of human-powered humanoid devices. The human-powered humanoid devices can be configured for playing various simulated sports. These simulated sports can include, inter alia, Baseball, Cricket, Dance/Martial art steps and similar sports experiences. For example, human-powered humanoid devices can be integrated with games with and played indoors. These games can be table-top games of the various simulated sports. Examples of tabletop games can include, inter alia: baseball tabletop game toy invention; cricket tabletop game toy invention; cricket table-top game toy advanced game play invention.

The human-powered humanoid devices can include one or more dynamic on-demand gear train/pulley train selectors. It is noted that human-powered humanoid devices can be adapted for other mechanical figure types as well (e.g. animals, mechanical pitching device, various other game play devices, etc.). Human-powered humanoid devices can be adapted to simulate the actions of the various player positions (e.g. pitcher, batter, bowler, kicker, dancer, etc.) of the of the simulated sports. An adaption of the human-powered humanoid device to baseball is now discussed.

Example Baseball Tabletop Game with Human-Powered Humanoid Devices

FIG. 1 illustrates an example baseball home plate 100 for mounting a baseball batter, according to some embodiments. As shown, bottom plate 114 and top plate 106 are the top and the bottom plates for baseball home plate respectively. Bottom plate 114 and top plate 106 can include various shaft, mountings, etc. for holding gears 108, 110, 112 as shown.

Mesh 102 provides a strike zone marker. If a ball hits any area of mesh 102 a strike can be called during a simulated baseball game. In this way, mesh 102 serves as a visible marker while playing the game. Stand 104 functions as a stand for mesh 102. Stand 104 can be held by a mounting/hole in top plate 106.

Mechanical force (e.g. rotation force/torque, etc.) can be transmitted to a baseball batter via gears 108, 110, and 112. Gears 108, 110 and 112 can operate in tandem. For example, a handle/lever 116 can be coupled with gear 112. When a user pulls the handle/lever 116 on gear 112, it causes gear 108 to rotate. Gear 108 can be connected to a shaft on the baseball batter on a leg shaft. Applying force to the leg shaft can cause an upper torso rotation in the baseball batter (e.g. see infra).

Accordingly, when the user pulls the handle on gear 112, it causes the upper torso rotation of the baseball batter. The handle is been placed such that it (and the player's hand) is not in the way of the gameplay.

Figure 2:
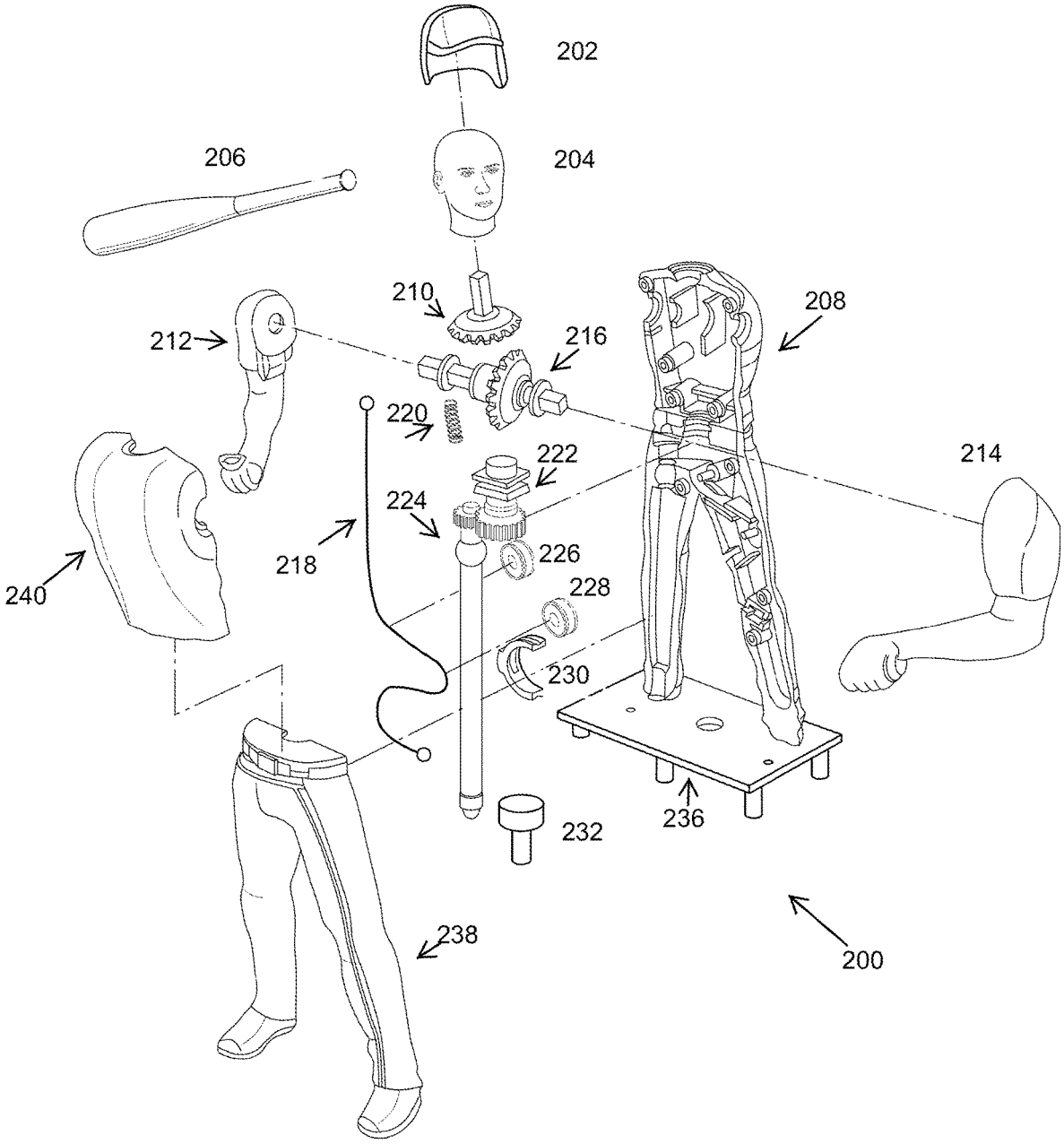
FIG. 2 illustrates an example exploded view of a humanoid batter, according to some embodiments.

FIG. 2 illustrates an example exploded view of a humanoid batter, according to some embodiments. More specifically, FIG. 2 shows an exploded view of all the mechanical components of a baseball batter. Baseball batter 200 can be a humanoid robot powered by mechanical force applied by a player. The elements of baseball home plate 100 and baseball batter 200 (and/or as well the cricket-player systems discussed infra) can be composed of various alloys, plastics, polymers, etc. Example polymers and plastics can include, inter alia: Bisphenol-A, Polystyrene, polymers (e.g. high- and low-density polyethylene (LDPE, HDPE), polypropylene (PP), polyvinylchloride (PVC), polystyrene (PS, ABS), polycarbonate (PC), and polyester (PET)), etc.

Baseball batter 200 can include various aesthetic elements (e.g. a helmet 202, head 204, upper torso cover 240, legs cover 238, etc.). Head 204 can be attached to a shaft of gear 210. Gear 210 can cause head 204 to turn in a realistic manner as a batting motion is performed by baseball batter 200. Gear 210 can receive torque from shoulder gear 216.

Baseball batter 200 can be mounted to baseball home plate 100 (e.g. to shaft of gear 108). Gear 108 can connect to leg shaft 224. Leg shaft 224 can be a slide gear that connects to hip gear 222. This can cause the upper torso of baseball batter 200 to rotate. In this way, two different movements and/or rotations are used for this gameplay for the baseball batter. A first movement/rotation can be the upper torso rotation. This can be provided by handle/lever 116 as described supra. The handle/lever 116 motion can translate eventually into the force that are separated by the mechanical system show inside baseball batter 200. Force can be translated to bat 206. Bat 206 can be held by arms 214 and 216. It is also noted that shoulder rotation up and down can be implemented. In this way, two axis of rotation are provided by baseball batter 200. These are independent of each other for proper gameplay. The shoulder and/or the bat rotation can be up and down.

Metal wire rope 218 connects to the shoulder gear 216. Metal wire rope 218 can function as an actuator for baseball batter 200. Metal wire rope 218 traverses through the hollow hip gear 222 and is then attached into the leg area around the knee of leg of baseball batter 200. Trigger/handle 230 can be used (e.g. pulled) to cause the movement of the bat 206 in an up and/or down manner.

Baseball batter 200 can simultaneously rotate its upper torso and shoulder in a manner that each rotation is independent of the other. For example, Metal wire rope 218 can be inserted into the illustrated system through the center of the rotation of the upper torso portion because that's where there is no rotation happening in hip gear 222 even as the upper torso rotates. Metal wire rope 218 is placed in a central manner such that when metal wire rope 218 is pulled, the shoulder rotation occurs without impacting the torso rotation. Additionally, when the torso rotation occurs, it does not impact the upper shoulder rotation. In this way, the upper shoulder rotation and the torso rotation can happen simultaneously but independent of each other.

Spring 220 can store mechanical energy to return the upper shoulder, the torso, and metal wire rope 218 to an initial state before metal wire rope 218 was pulled. Spring 220 can be pull only. Pulleys 226 and 228 can be used to support movement and change of direction of metal wire rope 218. In this way, a user can cause the rotation the upper shoulder and the torso back and forth due to the pulling of metal wire rope 218 and then letting spring 220 bring both them back with a counter rotation.

Pulleys 226 and 228 are used to reduce the friction and to enable a smooth rotation when metal wire rope 218. Base 236 connects the humanoid figure to baseball home plate 100. Knob 232 fixes this firmly to baseball home plate 100 such that the humanoid figure is not loosened during game play.

Figure 3:
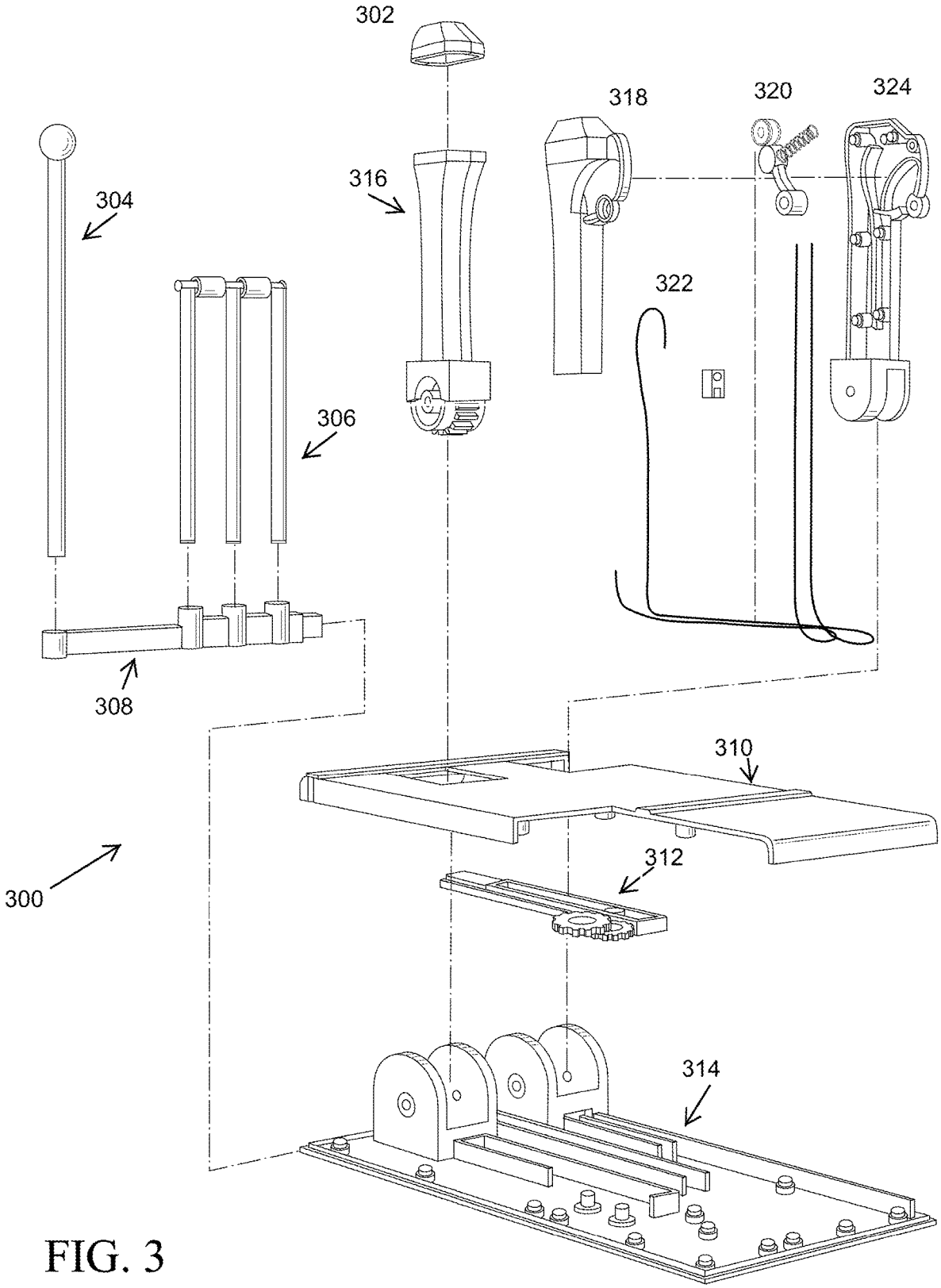
FIG. 3 illustrates an exploded view of an example platform for a cricket batter, according to some embodiments.

FIG. 3 illustrates an exploded view of an example platform 300 for a cricket batter 400, according to some embodiments. Cricket batter 400 is a humanoid form for cricket game play. It is noted that baseball batter 200 gameplay uses two axis of rotation. As the batting motion for cricket is more complex, cricket batter 400 uses three axis of rotation. FIG. 3 illustrates the mechanisms for achieving the three axis of rotation in cricket batter 400.

Cricket batter platform 300 includes stand top 314. Stand top 310 provides a base to attach cricket batter 400. Stand top connects to stand 314. Rack and pinion system 312 utilize a rack and pinion as gears to implement the upward torso rotation of cricket batter 400. This can be in a similar manner in the baseball humanoid discussed supra. In one example of platform 300, specified sizes and specified positioning can be selected depending on the type gameplay found in each particular game (e.g. baseball, cricket, etc.). Wicket assembly elements (e.g. 304, 306, and 308) provide the wickets for game play. When the ball hits the wickets then the cricket batter 400 is out. Wicket assembly elements includes wicket 306, wicket support rod 308 and wicket marker 304. Wicket marker 304 is used to determine that any pitch beyond it is not a valid ball. Controller 316 is used for the upper torso rotation of cricket batter 400 such that it can be made to rotate clockwise and anticlockwise. Cap 302 serves as a cap on control 316. When controller 316 is rotated forward or backward, the gear tooth at the base of the controller cause the rack to move back and forth which causes the pinion to rotate in clockwise and counterclockwise direction, which effectively causes the hip gear 418 to rotate. Controller 318/324 can be used to implement additional cricket batter 400 movement. While controller 316 controls the hip rotation via the controller 318/324 helps controller two different types of rotation—the shoulder rotation and the left hand forward and backward rotation. Additionally while the controller 316 uses the rack-pinion to achieve the rotation, the controller 318/324 uses wire ropes to achieve the desired rotations. Controller 318/324 includes a trigger to pull wire ropes 322.

Wire ropes 322 is the wire rope is used to power the two different movements using spring a 320. Wire rope 322 can be pulled and spring 320 plays the role of counter pulling the system back to a state before the pulling of wire ropes 322. When the controller is rotated forward, it causes the wire rope to be pulled. This wire rope is connected to the left-hand upper arm on the other end. When it gets pulled, it causes the hand to rotated forward allowing the bat to hit the ball in straight line known as straight-drive in cricket. When the controller is moved back, the spring attached near the armpit area of the left hand pulls the hand back to the starting position.

When the trigger is pulled it causes the second wire rope 410 to be pulled. This wire rope is attached to the shoulder shaft and causes it to rotate upwards, thereby achieving the bat 406 rotation in upward and downward direction. Once the controller 318/324 is rotated back, the spring 320 attached to the shoulder shaft brings the shoulder back in starting position.

Using the two controllers 316 and 318/324, bat 406 can be rotated across 3 different axis independent of each other thereby making it possible to hit all the cricket shots required for the game play.

Figure 4:
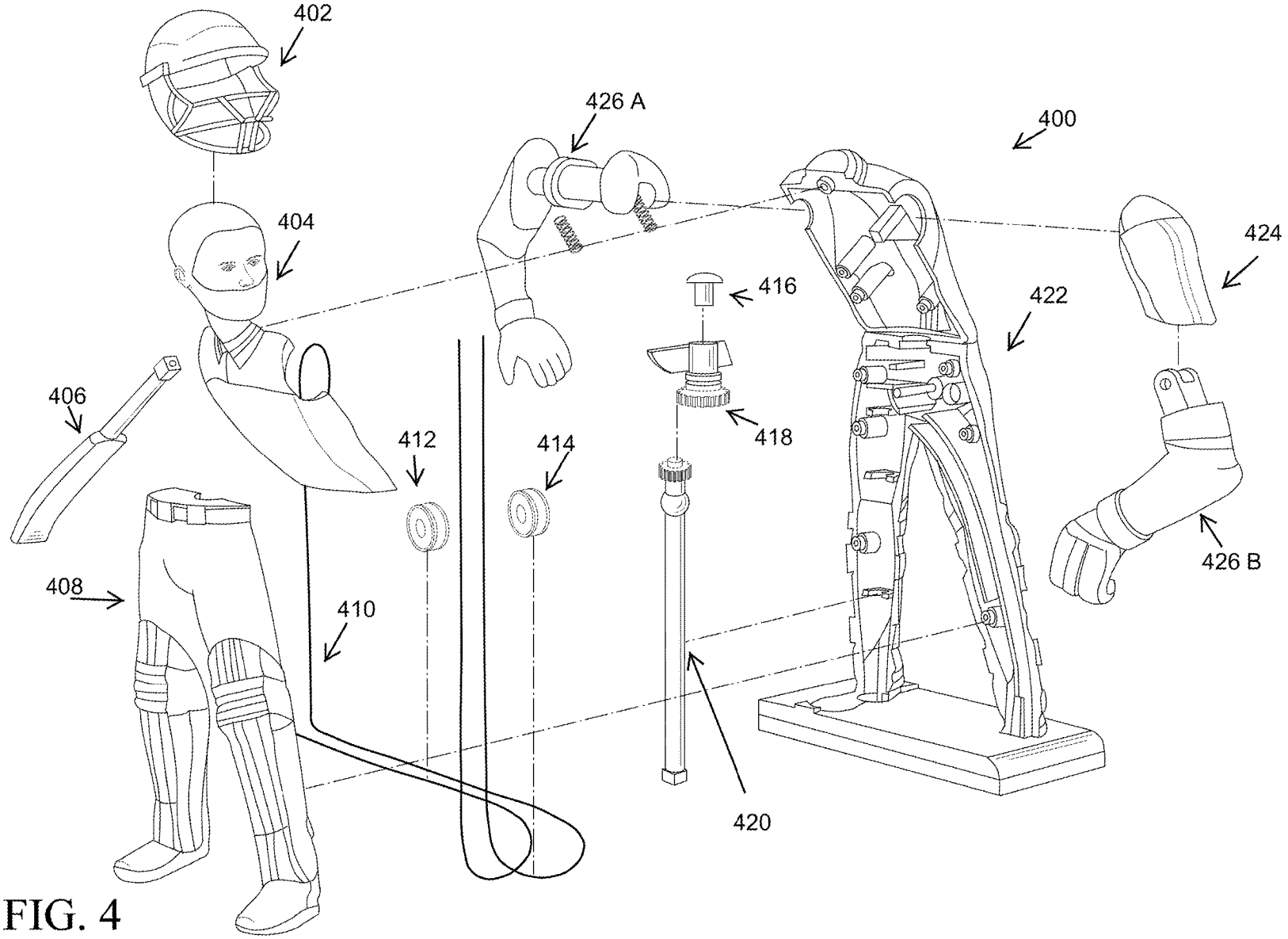
FIG. 4 illustrates an exploded view of an example cricket batter, according to some embodiments.

FIG. 4 illustrates an exploded view of an example cricket batter, according to some embodiments. Cricket batter 400 includes helmet 402 placed on head of front humanoid portion 404. Cricket batter 400 holds cricket bat 406. Cricket bat 406 is used to hit a ball bowled at wicket 306. A bowler humanoid (not shown) can bowl the ball. Cricket batter 400 also includes leg portion 408. The back portion 422 of cricket batter 400 is used to enclose the internal mechanical system.

More specifically, FIG. 4 shows the internal mechanism of mechanical components of cricket batter 400. As noted supra, cricket batter 400 is capable of three motions used for the cricket gameplay. The motion of cricket batter 400 can include an upper torso rotation. The motion of cricket batter 400 can include a back-and-forth motion. The motion of cricket batter 400 can include a shoulder rotation (e.g. as with the baseball batter 300 provided supra).

Cricket batter 400 can include arms 426 A-B. Arms 426 A-B hold bat 406. Left arm 426 B can be connected to shoulder 424. Shoulder rotation 424 can up and down. Cricket batter 400 can cause bat 406 to move forward and backward with user-controlled variation to enable different types of hits as a response to different bowls. Bat 406 moves forward and backward as a third-axial rotation.

Leg shaft 420 connects the internal structure of cricket batter 400 to cricket-batter platform 300. Accordingly, when controller 316 is moved it causes leg shaft 420 to rotate the various internal gears. This rotation can cause rotation in hip gear 418. Hip gear 418 is in the hip area of cricket batter 400. Hip gear 418 can rotate and cause the upper torso of cricket batter 400 to rotate. Pin 416 is a pin for hip gear 418.

The shoulder rotation of right arm 426 A can be implemented by pulling wire ropes 410 (e.g. can be wire ropes 322, etc.). Wire ropes 410 goes through cricket-batter platform 300 through the legs of cricket-batter 400. Wire ropes 410 can be supported via pulleys 412 and 414. Pulley 412 and 414 can be attached to inner surface of the legs of cricket-batter 400 with shafts as shown. Wire rope 410 is placed through the hollow hip gear 418 and then connects right arm 426 A such that when the trigger of controller 318/324, then wire ropes 410 is pulled and the rotation of the shoulder up and down is implemented.

A third rotation of cricket batter 400 is now discussed. Wire rope 410 can be run through the legs of cricket batter 400 through the center of the hip gear 418. Wire rope 410 also runs through a small opening of arms 426 A-B. Spring (s) are connected to arms 426 A-B such that when a user moves controller 324, it can pull the wire ropes 410 and cause the cricket-batter hand to move forward. This hand is attached to a bat 406 in order to bat a bowled ball.

As shown, springs are coupled with arm 426 A such that when a force from wire ropes 410 it causes arm 426 A. Wire ropes 410 can use hip gear 418/leg shaft 420 system as a supporting mechanism to counterpull back and enable the springs to cause movement of 426 A.

It is noted that the three movements discussed herein are independent of each other for the gameplay. Accordingly, a gameplayer can make sure that one independent moment does not cause any obstruction or unexpected movement of another movement. To achieve this only one movement/rotation is done with the help of gears and the rest of the movements/rotations are achieved with the help of wire rope and spring mechanism. Wire ropes 410 can be run through the center of cricket batter 400 to enable the rotation movements as the key points are originated in the hip area. For example, wire ropes 410 can be run through the center area so that the upper torso rotation of cricket batter 400 such that the center of the point does not move. Wire ropes 410 can be connect to arm 426 A so when the shoulder is rotating the center it does not impact forward movement of arm 426 A. Pulleys 412 and 414 are used to reduce friction one on wire ropes 410 when they are pulled.

Figure 5:
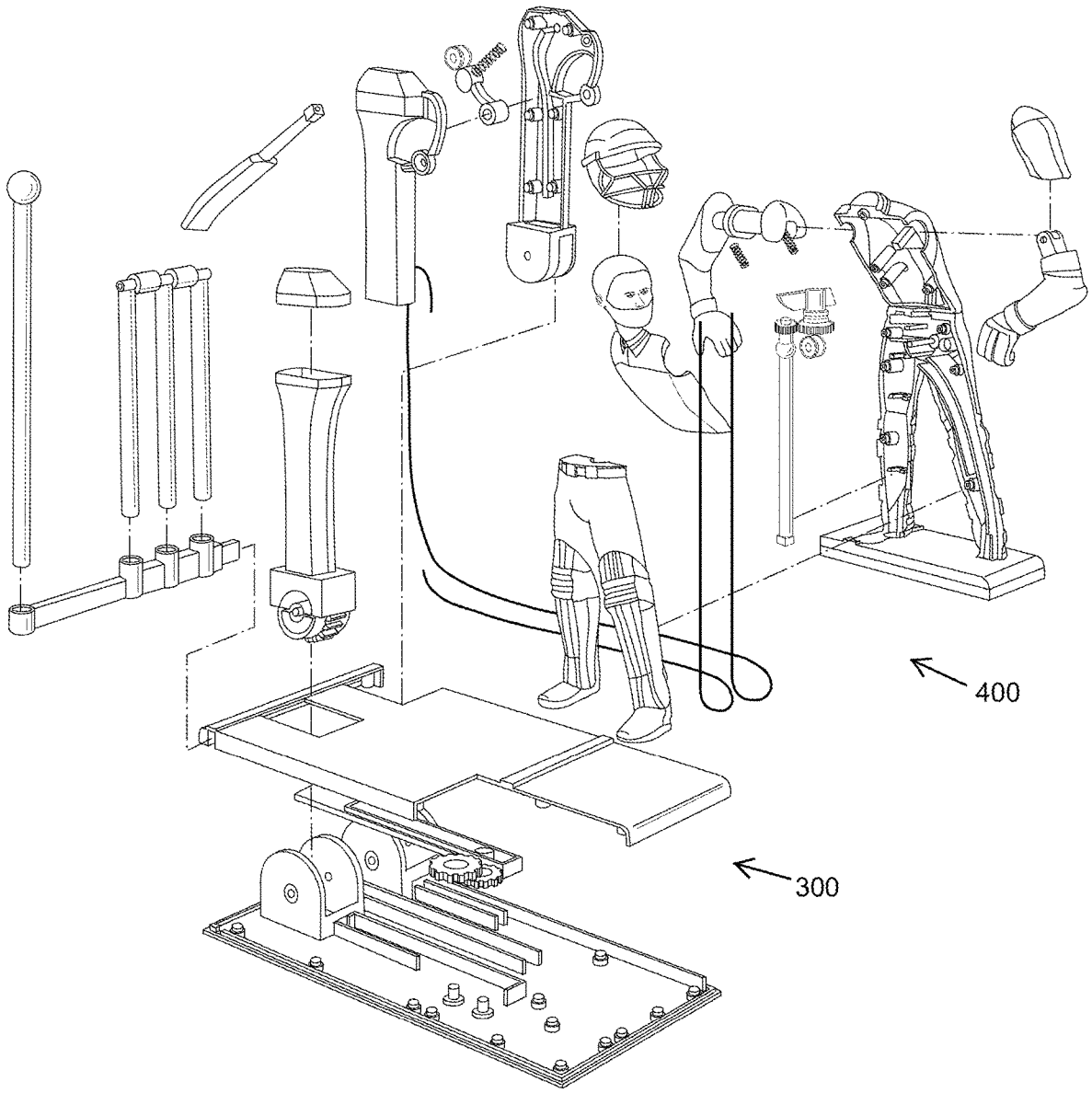
FIG. 5 illustrates an exploded view of example integration of platform and cricket batter, according to some embodiments.

FIG. 5 illustrates an exploded view of example integration of cricket-batter platform 300 and cricket batter 400, according to some embodiments.

Figure 6:
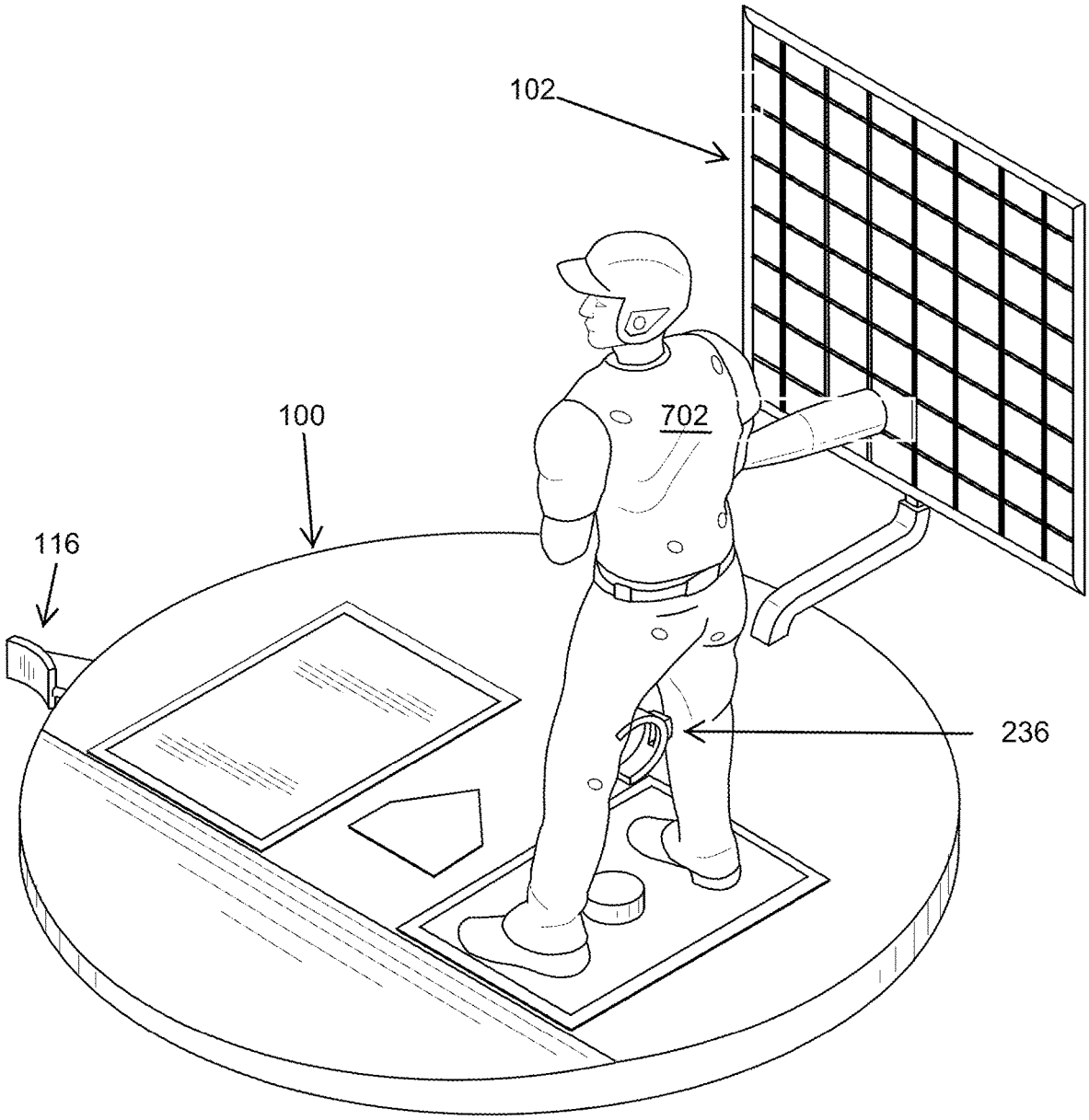
FIG. 6 illustrates an example base-ball batter humanoid figure attached to a home plate, according to some embodiments.

FIG. 6 illustrates an example base-ball batter humanoid figure attached to a home plate, according to some embodiments. Base-batter humanoid figure can be humanoid FIG. 702. As shown in FIG. 6, home plate 100 includes lever 116. Lever 116 enables a user to adjust the shoulder orientation of humanoid FIG. 702. As shown, humanoid FIG. 702 can include trigger/handle 230. Trigger/handle 230 is used to pull the bat into a position for hitting an incoming miniature baseball during gameplay.

Figure 7:
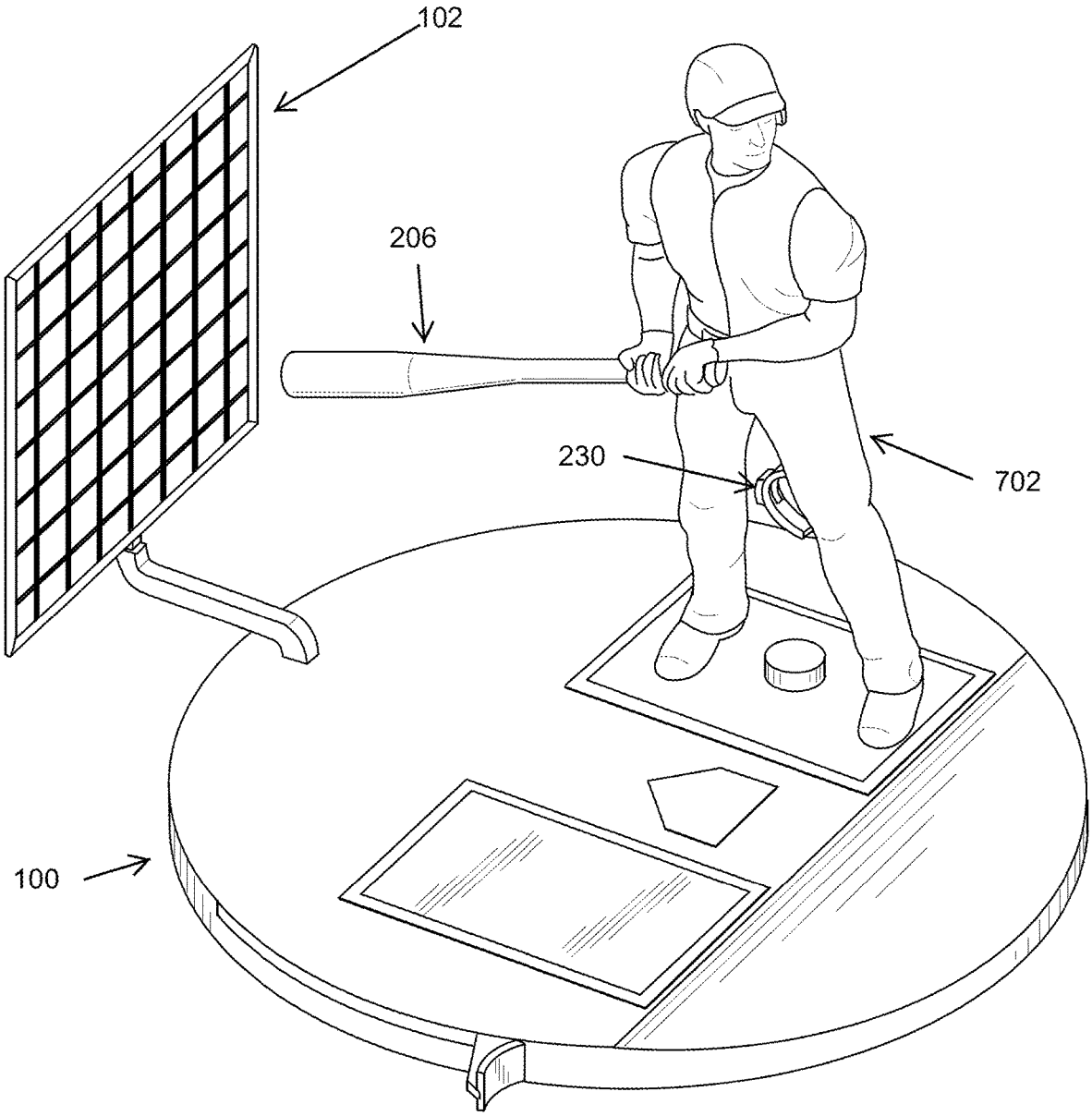
FIG. 7 illustrates an example base-ball batter humanoid figure attached to a home plate, according to some embodiments.

FIG. 7 illustrates an example base-ball batter humanoid figure attached to a home plate, according to some embodiments. As shown, humanoid FIG. 702 (e.g. baseball batter 200, base-ball batter of FIG. 6 supra, etc.) can be attached to baseball home plate 100. Trigger/handle 230 can be located on the left leg of humanoid FIG. 702. Trigger/handle 230 can be attached to a wire (e.g. Metal wire rope 218) to cause rotation in specified parts of humanoid FIG. 702 (e.g. waste portion, shoulder portion, etc.). A user can pull metal wire rope 218 (e.g. with a left-hand index finger). Trigger/handle 230 is placed such that the user can manipulate humanoid FIG. 702 can not impact the gameplay with user hands, fingers, etc.

Figure 8:
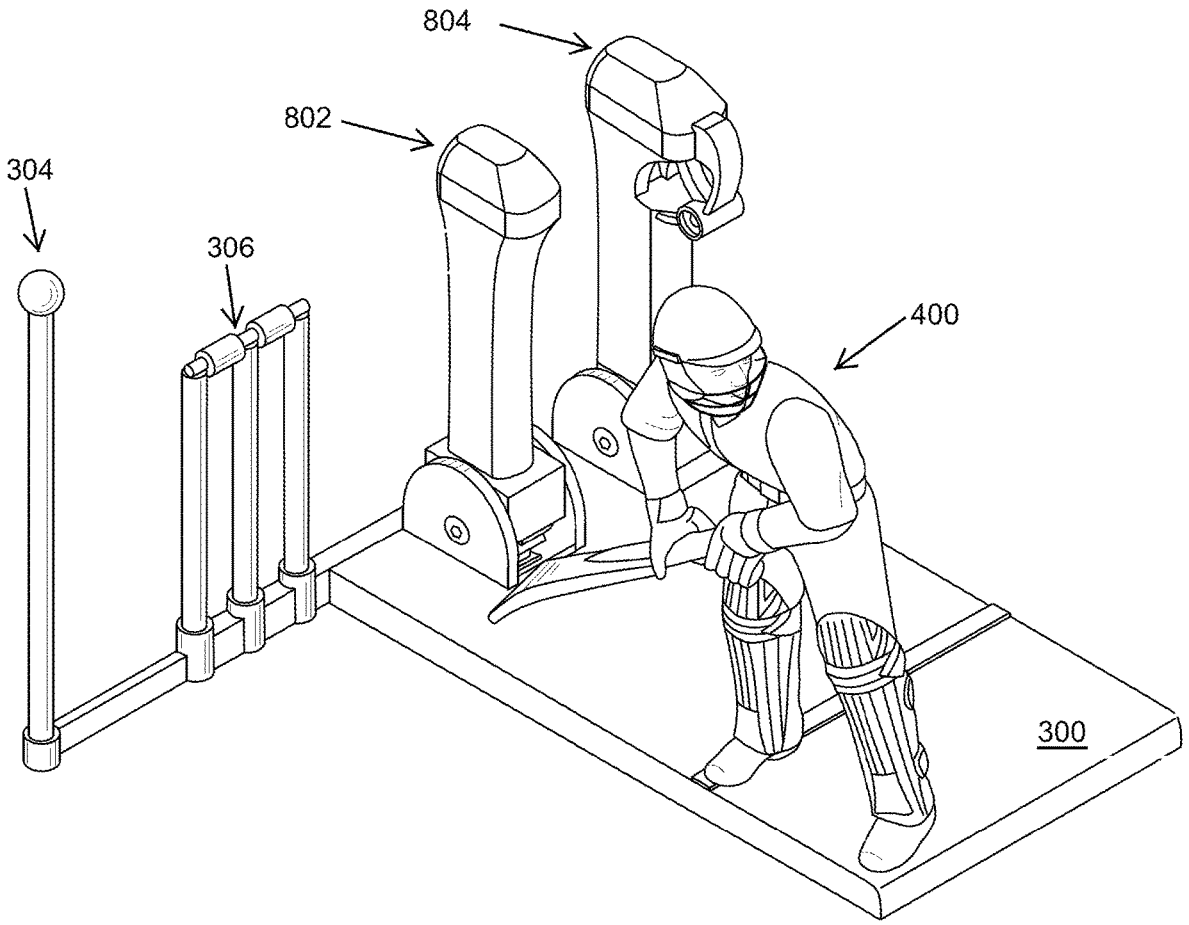
FIGS. 8-9 illustrates non-exploded perspective views of example integration of a cricket-batter platform and a cricket batter, according to some embodiments.
Figure 9:
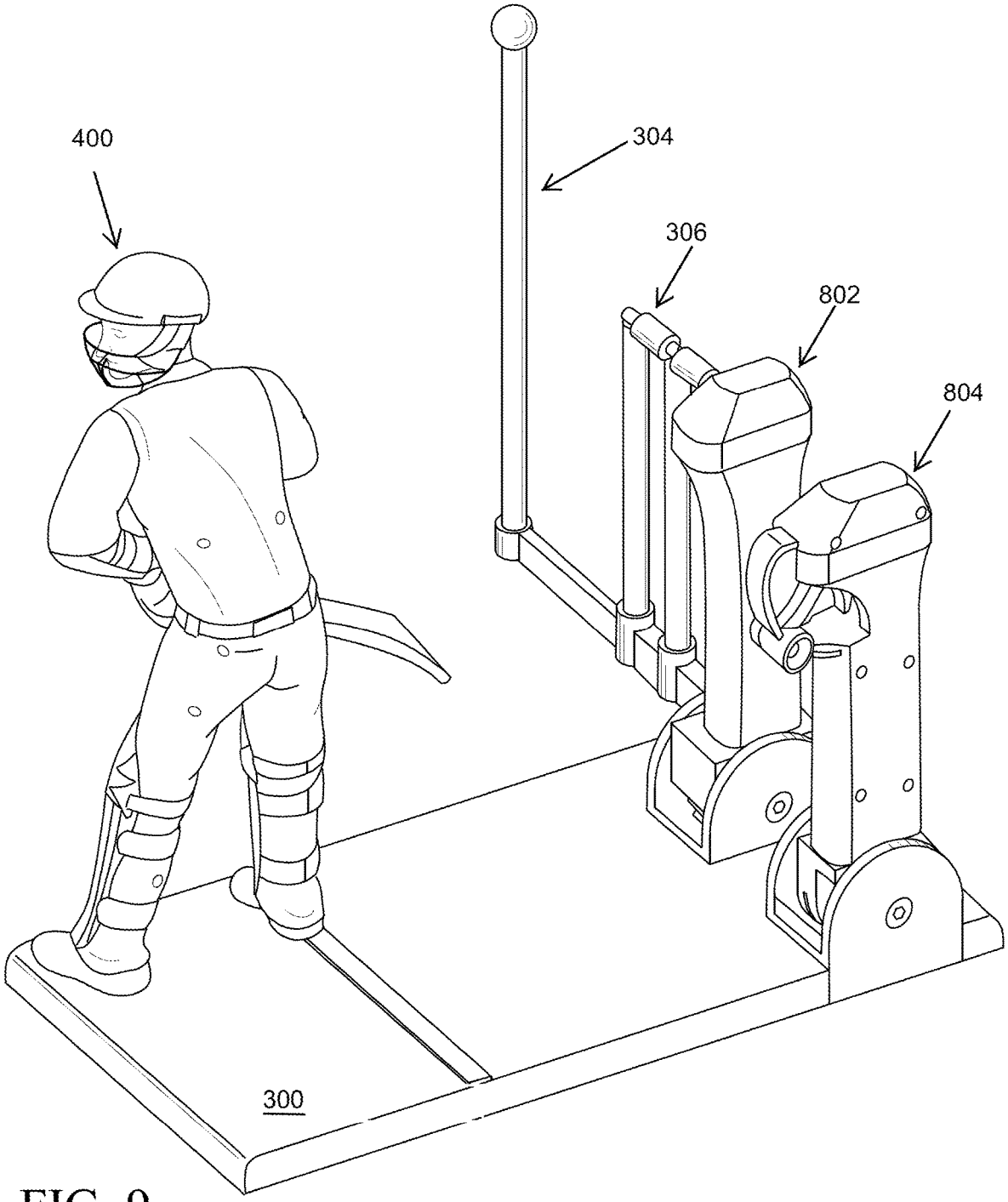

FIGS. 8-9 illustrates non-exploded perspective views of example integration of cricket-batter platform 300 and cricket batter 400, according to some embodiments. FIGS. 8 and 9 provide a perspective of baseball cricket player figure. As noted supra, there are two controllers (e.g. can be controllers 316 and 318/324). As shown, controllers can be levers manipulated by a human player during gameplay. Controllers 316 and 318/324 are used to achieve three different rotations and/or movements used to bat a bowled ball. Controller 318/324 includes a forward knob/trigger and is used to implement two different moments when controller 318/324 is moved forward. This can cause the bat and the hand to move forward. When a human user pulls a trigger on controller 318/324, it causes the shoulder to move up and down.

Controllers 316 and 318/324 can also used to implement batter hip rotation. Controllers 316 and 318/324 can cause the upper torso to move clockwise/counterclockwise via the specified gear mechanisms in the batter's upper torso. Controllers 316 and 318/324 can have two wire ropes that are placed in from the front leg and into a hip gear and then into the shoulder. One of the two wire ropes can the shoulder and the other wire can connect to the to the front hand.

The components of FIGS. 1-9 can be a combination of materials. In one example, the batter components, top plate and all those things would be ABS. The gears components can be made of POM. Wire ropes can be metallic wire. Joints, connection points and the like can be made of metal as well. Controllers 316 and 318/324 can circular connectors that connect the controller to the plate. These can be made of specified metals and screws. Pullies inside player figures can be made of metal(s). Gears can be ABS and/or POM as well.

CONCLUSION

Although the present embodiments have been described with reference to specific example embodiments, various modifications and changes can be made to these embodiments without departing from the broader spirit and scope of the various embodiments.

What is claimed:

1. A humanoid batter toy system comprising:

a baseball home plate for mounting a baseball batter humanoid, wherein the baseball home plate comprises:

a bottom plate, a top plate, wherein the top plate is coupled with the bottom plate, wherein a cavity between the coupled top plate and bottom plate includes a lever coupled with a first gear of a set of gears that are coupled with a leg shaft in a leg of the baseball batter humanoid and wherein the set of gear transfers a torque force to the leg shaft; and the baseball batter humanoid comprising:

wherein the leg shaft is coupled to a hip gear in the baseball batter humanoid, wherein the hip gear receives the torque force and uses the torque force to cause an upper torso of baseball batter humanoid to rotate a baseball bat held by the baseball batter humanoid in a batter swinging motion, wherein the upper torso of the baseball batter humanoid comprises a metal wire rope passing through a center of the rotation of an upper torso portion of the baseball batter humanoid, wherein the metal rope is placed in a central manner within the upper torso portion such that when metal wire rope is pulled, a shoulder rotation of the baseball batter humanoid occurs without impacting a torso rotation, and wherein the baseball batter humanoid is mounted to the top plate such that the leg shaft receives the torque force from the set of gears.

2. The humanoid batter toy system of claim 1, wherein the leg shaft comprises a slide gear.

3. The humanoid batter toy system of claim 2, wherein the upper torso of baseball batter comprises two arms.

4. The humanoid batter toy system of claim 3, wherein the two arms hold a bat used to hit a toy ball.

5. The humanoid batter toy system of claim 4, wherein the shoulder rotation controls the placement of the two arms holding the bat during the batter swinging motion.

6. The humanoid batter toy system of claim 4, wherein the baseball batter humanoid comprises two independent axes of rotation such that a shoulder is moved in an up and down manner independent of a torque force of a bat rotation of the batter swinging motion.

7. The humanoid batter toy system of claim 1, wherein the metal wire rope connects to a shoulder gear also in the upper torso of the baseball batter humanoid.

8. The humanoid batter toy system of claim 7, wherein the metal wire rope comprises an actuator for the baseball batter humanoid.

9. The humanoid batter toy system of claim 8, wherein the metal wire rope traverses through a hollow of the hip gear and is then attached into a leg area around a knee of leg of the baseball batter humanoid.

10. The humanoid batter toy system of claim 9, wherein the baseball batter humanoid further comprises a handle that when pulled causes the metal wire rope to cause a movement of the bat in an up and down manner.

11. The humanoid batter toy system of claim 1, wherein the set of gears comprises three gears, wherein a first gear receives a torque force from the lever and transfers the torque force to a second gear, wherein the second gear transfers the torque force to a third gear, and wherein the third gear transfers the torque force to the leg shaft.

12. A humanoid batter toy system comprising:

a cricket batter humanoid:

wherein the cricket batter humanoid holds a cricket bat used to hit a ball bowled at a wicket, wherein the cricket batter humanoid uses three axis of rotation, wherein the cricket batter humanoid causes a bat to move forward and backward based on a user-controlled variation provided to a set of controllers such that the cricket batter humanoid is able to perform a specified hit type as a response to the bowled ball:

wherein in a first axis of rotation, the set of controllers are used for an upper torso rotation of the cricket batter humanoid such that the upper torso rotation of the cricket batter humanoid is made to rotate clockwise and anticlockwise, wherein in a second axis of rotation, the set of controllers are used for a shoulder rotation of the cricket batter humanoid in an up and down manner, wherein in a third axis of rotation, left hand forward and backward rotation such that the bat is moved in a forward and backward motion as the third-axial rotation;

wherein the cricket batter humanoid comprises a leg portion coupled with a cricket batter platform;

a cricket batter platform that holds the cricket batter humanoid:

wherein the cricket batter platform comprises a stand top that provides a base to attach the cricket batter humanoid, wherein the stand top connects to a stand and a rack and pinion system comprising the set of gears used to implement the three axes of rotation of the cricket batter humanoid via the set of controllers; and the wicket connected with the cricket platform.

13. The humanoid batter toy system of claim 12, wherein when a controller of the set of controllers is rotated forward or backward, a gear tooth at a base of the controller causes a rack to move back and forth which in turn causes a pinion to rotate in a clockwise and counterclockwise direction, which causes a hip gear of the cricket batter humanoid to rotate in the first axis of rotation.

14. The humanoid batter toy system of claim 13, wherein another controller of the set of controllers uses at least one wire rope to implement the second axis of rotation and the third axis of rotation.

15. The humanoid batter toy system of claim 14, wherein the cricket batter humanoid encloses an internal mechanical system operated by the set of controllers.

16. The humanoid batter toy system of claim 15, wherein when the controller is rotated forward, the wire rope is pulled, and wherein in the wire rope is connected to a left-hand upper arm of the humanoid cricket batter.

17. The humanoid batter toy system of claim 16, wherein when the wire rope pulled, the wire rope causes a hand to rotate forward allowing the bat to hit the ball in straight line.

18. The humanoid batter toy system of claim 17, wherein when the controller is moved backwards, a spring attached near an armpit area of a left hand pulls the hand back to a starting position.

19. The humanoid batter toy system of claim 18, wherein the cricket batter humanoid is configured to enable a specified user-controlled variation to enable different types of hits as a response to different types of bowls.

* * * * *